US006471091B1

(12) United States Patent
Unverzagt

(10) Patent No.: US 6,471,091 B1
(45) Date of Patent: Oct. 29, 2002

(54) LABEL HOLDING AND DISPENSING DEVICE

(76) Inventor: Peter C. Unverzagt, 815 E Oakton #193, Des Plaines, IL (US) 60018

( * ) Notice: Subject to any disclaimer, the term of this patent is extended or adjusted under 35 U.S.C. 154(b) by 161 days.

(21) Appl. No.: 09/765,464

(22) Filed: Jan. 22, 2001

(51) Int. Cl.[7] ..... B65H 5/28

(52) U.S. Cl. ..... 221/185; 221/33; 221/45; 224/219

(58) Field of Search ..... 221/185, 45, 46, 221/33, 36; 224/219

(56) References Cited

U.S. PATENT DOCUMENTS

| | | | | | |
|---|---|---|---|---|---|
| 1,945,144 | A | * | 1/1934 | Follett et al. | 221/185 |
| D106,272 | S | | 10/1937 | Anderson | |
| 2,347,823 | A | * | 5/1944 | Goodman et al. | 221/185 |
| 2,480,764 | A | * | 8/1949 | Pennington | 221/185 |
| 2,560,381 | A | * | 7/1951 | Babington | 221/185 |
| 2,808,962 | A | * | 10/1957 | Warmath | 221/185 |
| 3,105,611 | A | * | 10/1963 | Conti | 221/185 |
| 4,401,233 | A | * | 8/1983 | Frey | 221/185 |
| 4,863,084 | A | * | 9/1989 | Nabozny | 224/253 |
| 4,896,465 | A | * | 1/1990 | Rhodes et al. | 51/391 |
| 5,127,545 | A | * | 7/1992 | French | 221/102 |
| 5,167,346 | A | * | 12/1992 | Bodziak | 221/63 |
| 5,299,712 | A | * | 4/1994 | Carlson | 221/45 |
| 5,311,689 | A | * | 5/1994 | Lindsey | 40/633 |
| 5,472,125 | A | * | 12/1995 | Barnard | 224/219 |
| 5,482,182 | A | * | 1/1996 | Thompson et al. | 221/73 |
| 6,227,406 | B1 | * | 5/2001 | Herlacher | 221/185 |

* cited by examiner

*Primary Examiner*—Christopher P. Ellis
*Assistant Examiner*—Rashmi Sharma

(57) ABSTRACT

A label holding and dispensing device for holding a plurality of labels on the wrist of user for easy access to the labels. The label holding and dispensing device includes a housing having a bottom wall with a peripheral wall attached to a peripheral edge of the bottom wall and extending upwardly therefrom. The peripheral wall bounds an interior of the housing, which has an open top side for accessing the interior. A slot extends down from a top edge of the peripheral wall to the bottom wall. A strap is flexible and has a first end, a second end, an outer surface and an inner surface. A fastening member removably fastens the inner surface of the strap to the outer surface of the strap. A securing member removably secures the housing to the strap. Each of a plurality labels has a shape substantially the same as a shape of the bottom wall. The labels are positioned on each other to define a stack, which is removably positionable in the housing.

10 Claims, 3 Drawing Sheets

LABEL HOLDING AND DISPENSING DEVICE

BACKGROUND OF THE INVENTION

1. Field of the Invention

The present invention relates to label dispensers and more particularly pertains to a new label holding and dispensing device for holding a plurality of labels on the wrist of user for easy access to the labels.

2. Description of the Prior Art

The use of label dispensers is known in the prior art. More specifically, label dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,401,233; 5,127,545; U.S. Des. Pat. No. 106,272; U.S. Pat. Nos. 5,472,125; 5,311,689; and 4,896,465.

While these devices fulfill their respective, particular objectives and requirements, the aforementioned patents do not disclose a new label holding and dispensing device. The inventive device includes a housing having a bottom wall with a peripheral wall attached to a peripheral edge of the bottom wall and extending upwardly therefrom. The peripheral wall bounds an interior of the housing, which has an open top side for accessing the interior. A slot extends down from a top edge of the peripheral wall to the bottom wall. A strap is flexible and has a first end, a second end, an outer surface and an inner surface. A fastening member removably fastens the inner surface of the strap to the outer surface of the strap. A securing member removably secures the housing to the strap. Each of a plurality labels has a shape substantially the same as a shape of the bottom wall. The labels are positioned on each other to define a stack, which is removably positionable in the housing.

In these respects, the label holding and dispensing device according to the present invention substantially departs from the conventional concepts and designs of the prior art, and in so doing provides an apparatus primarily developed for the purpose of holding a plurality of labels on the wrist of user for easy access to the labels.

SUMMARY OF THE INVENTION

In view of the foregoing disadvantages inherent in the known types of label dispensers now present in the prior art, the present invention provides a new label holding and dispensing device construction wherein the same can be utilized for holding a plurality of labels on the wrist of user for easy access to the labels.

The general purpose of the present invention, which will be described subsequently in greater detail, is to provide a new label holding and dispensing device apparatus and method which has many of the advantages of the label dispensers mentioned heretofore and many novel features that result in a new label holding and dispensing device which is not anticipated, rendered obvious, suggested, or even implied by any of the prior art label dispensers, either alone or in any combination thereof.

To attain this, the present invention generally comprises a housing having a bottom wall with a peripheral wall attached to a peripheral edge of the bottom wall and extending upwardly therefrom. The peripheral wall bounds an interior of the housing, which has an open top side for accessing the interior. A slot extends down from a top edge of the peripheral wall to the bottom wall. A strap is flexible and has a first end, a second end, an outer surface and an inner surface. A fastening member removably fastens the inner surface of the strap to the outer surface of the strap. A securing member removably secures the housing to the strap. Each of a plurality labels has a shape substantially the same as a shape of the bottom wall. The labels are positioned on each other to define a stack, which is removably positionable in the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new label holding and dispensing device apparatus and method which has many of the advantages of the label dispensers mentioned heretofore and many novel features that result in a new label holding and dispensing device which is not anticipated, rendered obvious, suggested, or even implied by any of the prior art label dispensers, either alone or in any combination thereof.

It is another object of the present invention to provide a new label holding and dispensing device which may be easily and efficiently manufactured and marketed.

It is a further object of the present invention to provide a new label holding and dispensing device which is of a durable and reliable construction.

An even further object of the present invention is to provide a new label holding and dispensing device which is susceptible of a low cost of manufacture with regard to both materials and labor, and which accordingly is then susceptible of low prices of sale to the consuming public, thereby making such label holding and dispensing device economically available to the buying public.

Still yet another object of the present invention is to provide a new label holding and dispensing device which provides in the apparatuses and methods of the prior art some of the advantages thereof, while simultaneously overcoming some of the disadvantages normally associated therewith.

Still another object of the present invention is to provide a new label holding and dispensing device for holding a plurality of labels on the wrist of user for easy access to the labels.

Yet another object of the present invention is to provide a new label holding and dispensing device which includes a housing having a bottom wall with a peripheral wall attached to a peripheral edge of the bottom wall and extending upwardly therefrom. The peripheral wall bounds an interior of the housing, which has an open top side for accessing the interior. A slot extends down from a top edge of the peripheral wall to the bottom wall. A strap is flexible and has a first end, a second end, an outer surface and an inner surface. A fastening member removably fastens the inner surface of the strap to the outer surface of the strap. A securing member removably secures the housing to the strap. Each of a plurality labels has a shape substantially the same as a shape of the bottom wall. The labels are positioned on each other to define a stack, which is removably positionable in the housing.

Still yet another object of the present invention is to provide a new label holding and dispensing device that holds labels for easy access when needed such that a user may wrap gifts in a more efficient manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
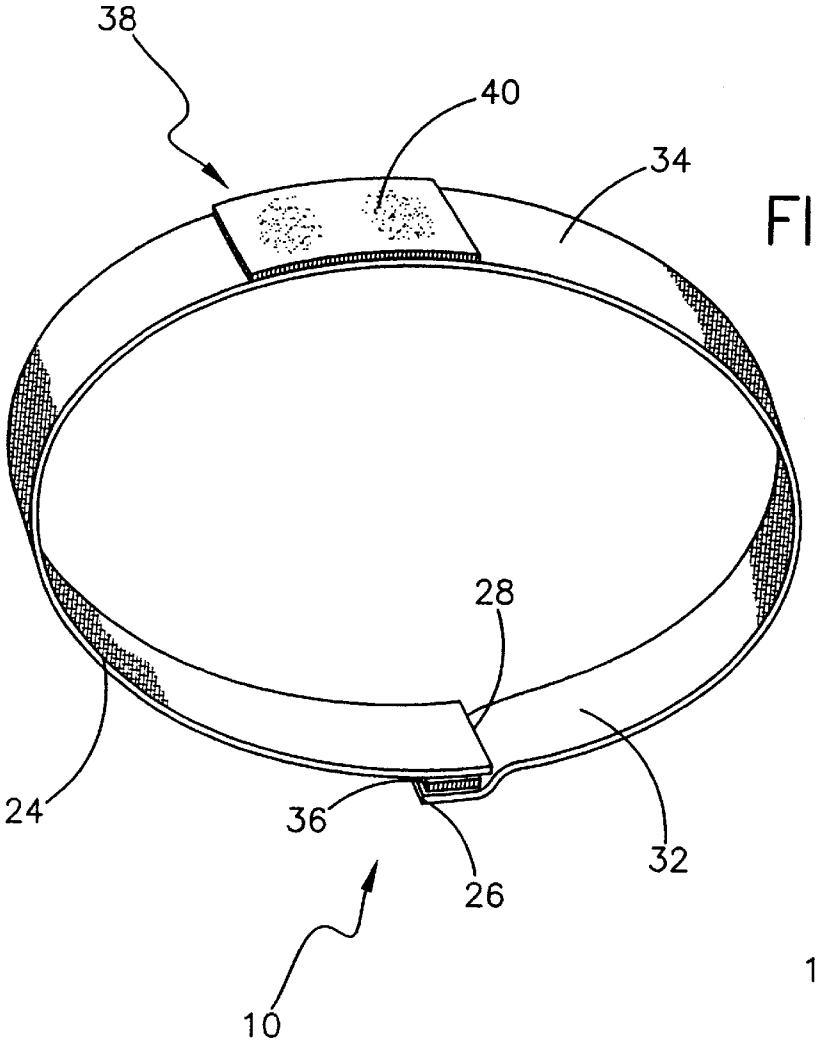
FIG. 1 is a schematic perspective view of a strap of a new label holding and dispensing device according to the present invention.
Figure 2:
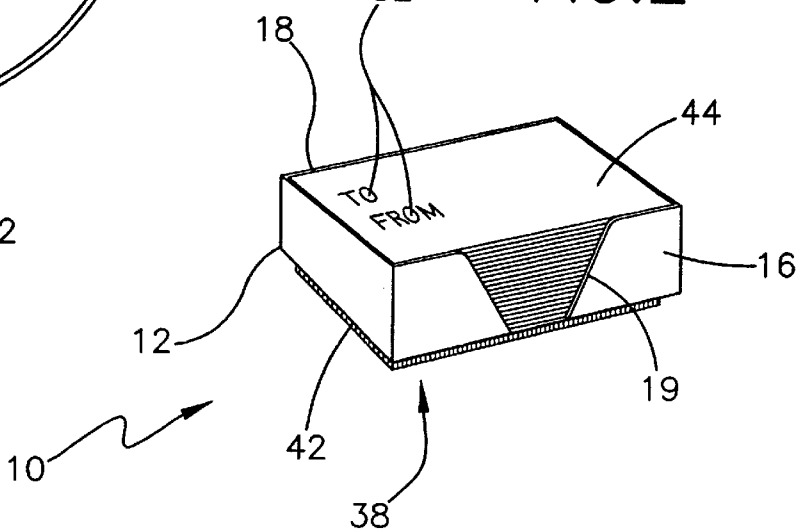
FIG. 2 is a schematic perspective view of a housing of the present invention.
Figure 3:
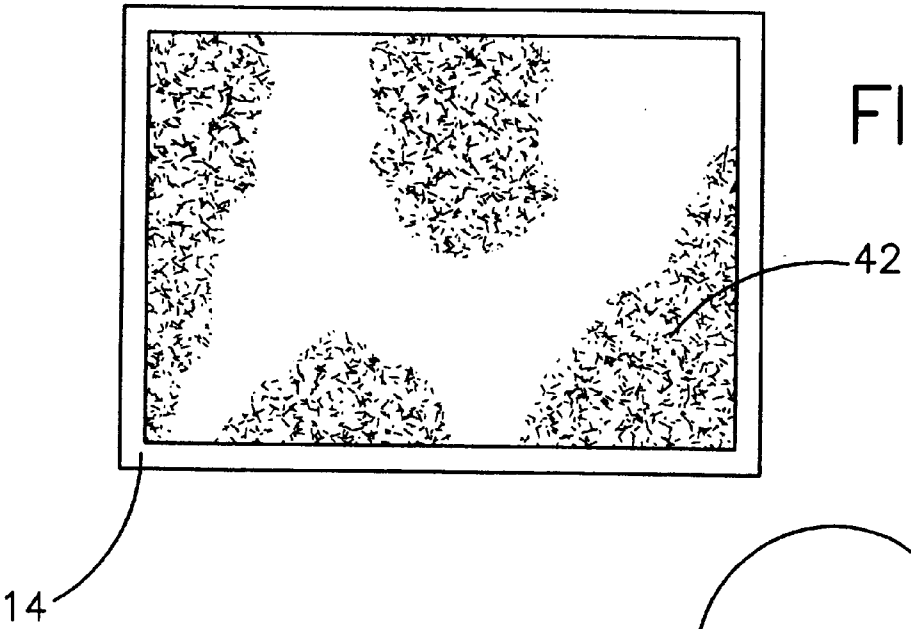
FIG. 3 is a schematic bottom view of the rectangular housing of the present invention.
Figure 4:
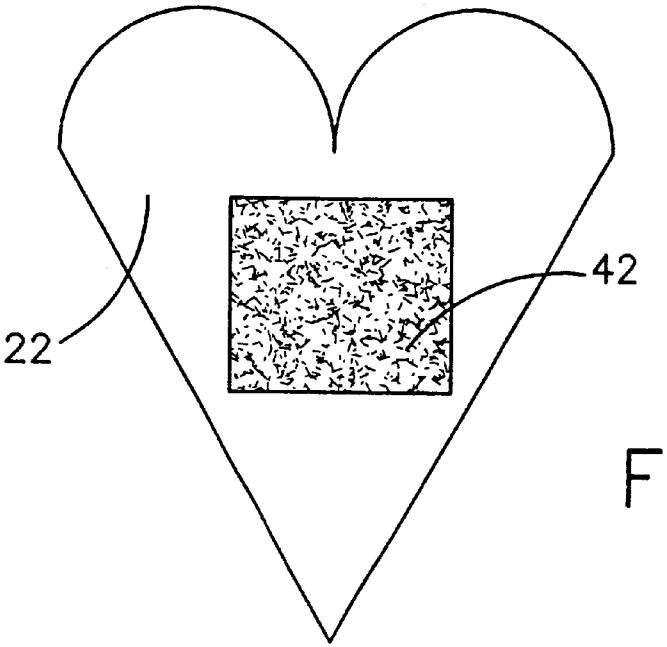
FIG. 4 is a schematic bottom view of the heart shaped housing of the present invention.
Figure 5:
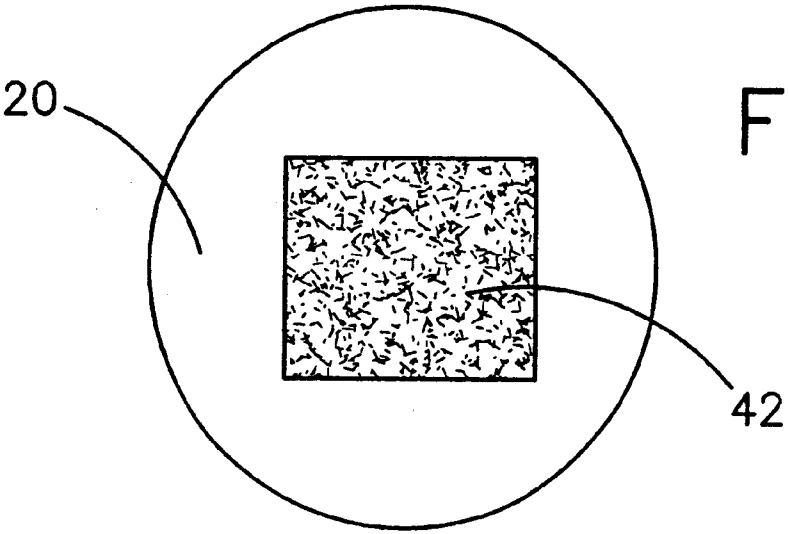
FIG. 5 is a schematic bottom view of the circular housing of the present invention.
Figure 6:
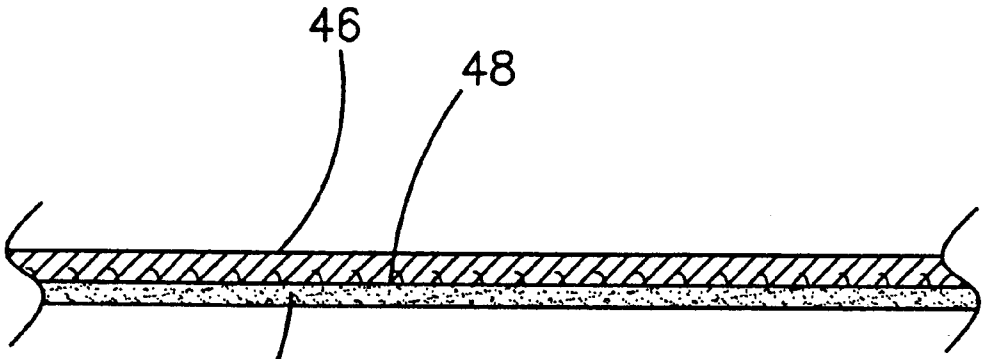
FIG. 6 is a schematic exploded cross-sectional side view of a label of the present invention.

With reference now to the drawings, and in particular to FIGS. 1 through 6 thereof, a new label holding and dispensing device embodying the principles and concepts of the present invention and generally designated by the reference numeral 10 will be described.

As best illustrated in FIGS. 1 through 6, the label holding and dispensing device 10 generally comprises a housing 12 having a bottom wall 14 with a peripheral wall 16 attached to a peripheral edge of the bottom wall 14 and extending upwardly therefrom. The peripheral wall 16 bounds an interior of the housing 12. The housing 12 has an open top side for accessing the interior. A slot 18 extends down from a top edge 18 of the peripheral wall 16 to the bottom wall 14. The slot 19 preferably has a V-shape. The bottom wall ideally has a generally rectangular shape. The bottom wall 14 has a length generally between 2 inches and 3 inches a width generally between 1 inch and 2 inches. The peripheral wall 16 has a height generally between 1 inch and 2 inches. Also envisioned are versions of the housing 12 having a circular shape 20 or a heart shape 22, though any number of shapes may be utilized.

A strap 24 is flexible and has a first end 26, a second end 28, an outer surface 34 and an inner surface 32. The strap 24 has a length generally between 5 inches and 9 inches.

A fastening member 36 removably fastens the inner surface of the strap to the outer surface 34 of the strap 24. The fastening member 36 includes a loop and hook fastening means. A hook portion is securely coupled to the inner surface 32 and is positioned generally adjacent to the first end 26. A loop portion is securely coupled to the outer surface 30 and is positioned generally adjacent to the second end 28.

A securing member 38 removably secures the housing 12 to the strap 24. The securing member 38 includes a hook and loop fastening means having loop portion 40 securely coupled to the outer surface 34 of the strap 24 and positioned between the first 26 and second 28 ends. A hook portion 42 of the securing member 38 is securely coupled to a bottom surface of the bottom wall 14.

Each of a plurality labels 44 has a front side 46 and a back side 48. Each of the back sides 48 has an adhesive coating 50 thereon. Each of the back sides 48 of the label 44 abuts a front side 44 of an adjacent label 44 such that the labels 44 are positioned upon each other to define a stack of labels 44. The labels 44 are removably secured to the adjacent labels with the adhesive 50 such that the labels 44 may be peeled off of the adjacently positioned label 44 and no adhesive 50 residue remains on the front side of the adjacent label. The stack of the labels 44 is positionable in the interior of the housing 12 such that the back side of a first of the labels is abutting a top side of the bottom wall 14 to hold the stack in the housing. Each of the labels 44 has a shape substantially similar to the bottom wall 14. Each of the labels 44 has a length and width substantial equal to the length and width of the bottom wall 14. Each of the front sides 46 of the labels 44 preferably has name indicating indicia 52 thereon indicating the words "To" and "From." The labels 44 are preferably made from a paper or a plastic material.

In use, the strap is positioned around the wrist of a user and secured in place with the fastening member. The housing is positioned on the strap with the securing member. The labels are then removed as needed from the housing and gripped by their edge which is exposed in the slot.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A label dispensing device attachable to a wrist of a user, said device comprising:

a housing having a bottom wall with a peripheral wall being attached to a peripheral edge of the bottom wall and extending upwardly therefrom, said peripheral wall bounding an interior of the housing, said housing having an open top side for accessing said interior, said peripheral wall having a top edge, a slot extending down from said top edge of said peripheral wall to said bottom wall;

a strap being flexible and having a first end, a second end, an outer surface and an inner surface;

a fastening member for removably fastening said inner surface of said strap to said outer surface of said strap;

a securing member for removably securing said housing to said strap; and a plurality of labels, each of said labels having a shape substantially the same as a shape of said bottom wall, said labels being positioned on each other to define a stack, said stack being removably positionable in said housing.

2. The label dispensing device as in claim 1, wherein said bottom wall has a circular shape.

3. The label dispensing device as in claim 1, wherein said bottom wall has a heart shape.

4. The label dispensing device as in claim 1, wherein said slot in said peripheral wall generally has a V-shape.

5. The label dispensing device as in claim 1, wherein said bottom wall has a generally rectangular shape, said bottom wall having a length generally between 2 inches and 3 inches, a width generally between 1 inch and 2 inches, said peripheral wall having a height generally between 1 inch and 2 inches.

6. The label dispensing device as in claim 1, wherein said fastening member includes a loop and hook fastening means, a hook portion being securely coupled to said inner surface and being positioned generally adjacent to said first end, a loop portion being securely coupled to said outer surface and being positioned generally adjacent to said second end.

7. The label dispensing device as in claim 6, wherein said securing member includes a hook and loop fastening means having loop portion securely coupled to said outer surface of said strap and positioned between said first and second ends, a hook portion of said securing member being securely coupled to a bottom surface of said bottom wall.

8. The label dispensing device as in claim 1, wherein said securing member includes a hook and loop fastening means having loop portion securely coupled to said outer surface of said strap and positioned between said first and second ends, a hook portion of said securing member being securely coupled to a bottom surface of said bottom wall.

9. The label dispensing device as in claim 1, wherein each of said labels has a front side and a back side, each of said back sides having an adhesive coating thereon, wherein said labels are removably secured to the adjacent labels with said adhesive such that said labels may be peeled off of the adjacently positioned label such that no adhesive residue remains on said front side of said adjacent label.

10. A label dispensing device attachable to a wrist of a user, said device comprising:

a housing having a bottom wall with a peripheral wall being attached to a peripheral edge of the bottom wall and extending upwardly therefrom, said peripheral wall bounding an interior of the housing, said housing having an open top side for accessing said interior, said peripheral wall having a top edge, a slot extending down from said top edge of said peripheral wall to said bottom wall, said slot generally having a V-shape, said bottom wall having a generally rectangular shape, said bottom wall having a length generally between 2 inches and 3 inches a width generally between 1 inch and 2 inches, said peripheral wall having a height generally between 1 inch and 2 inches;

a strap being flexible and having a first end, a second end, an outer surface and an inner surface, said strap having a length generally between 5 inches and 9 inches;

a fastening member for removably fastening said inner surface of said strap to said outer surface of said strap, said fastening member including a loop and hook fastening means, a hook portion being securely coupled to said inner surface and being positioned generally adjacent to said first end, a loop portion being securely coupled to said outer surface and being positioned generally adjacent to said second end;

a securing member for removably securing said housing to said strap, said securing member including a hook and loop fastening means having loop portion securely coupled to said outer surface of said strap and positioned between said first and second ends, a hook portion of said securing member being securely coupled to a bottom surface of said bottom wall; and a plurality of labels each having a front side and a back side, each of said back sides having an adhesive coating thereon, each of said back sides of said label abutting a front side of an adjacent label such that said labels are positioned upon each other to define a stack of labels, wherein said labels are removably secured to the adjacent labels with said adhesive such that said labels may be peeled off of the adjacently positioned label such that no adhesive residue remains on said front side of said adjacent label, said stack of said labels being positionable in said interior of said housing such that the back side of a first of said labels is abutting a top side of said bottom wall, each of said labels having a shape substantially similar to said bottom wall, each of said labels having a length and width substantial equal to the length and width of said bottom wall, each of said front sides of said labels having name indicating indicia thereon.

* * * * *